US010618759B2

(12) United States Patent
Anezaki

(10) Patent No.: US 10,618,759 B2
(45) Date of Patent: Apr. 14, 2020

(54) SHEET STACKING APPARATUS AND IMAGE FORMING SYSTEM

(71) Applicant: Konica Minolta, Inc., Chiyoda-ku, Tokyo (JP)

(72) Inventor: Tsutomu Anezaki, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/165,900

(22) Filed: Oct. 19, 2018

(65) Prior Publication Data

US 2019/0135573 A1 May 9, 2019

(30) Foreign Application Priority Data

Nov. 9, 2017 (JP) ..... 2017-216211

(51) Int. Cl.

| | |
|---|---|
| ***B65H 9/00*** | (2006.01) |
| ***B65H 29/12*** | (2006.01) |
| ***B65H 29/14*** | (2006.01) |
| ***B65H 43/08*** | (2006.01) |
| ***B65H 29/28*** | (2006.01) |
| ***B65H 29/00*** | (2006.01) |

(52) U.S. Cl.

CPC ..... *B65H 9/002* (2013.01); *B65H 29/003* (2013.01); *B65H 29/125* (2013.01); *B65H 29/14* (2013.01); *B65H 29/28* (2013.01); *B65H 43/08* (2013.01); *B65H 2301/331* (2013.01); *B65H 2301/4212* (2013.01); *B65H 2301/4474* (2013.01); *B65H 2301/44331* (2013.01); *B65H 2301/44712* (2013.01); *B65H 2511/242* (2013.01); *B65H 2801/06* (2013.01)

(58) Field of Classification Search

CPC ..... B65H 29/28; B65H 29/003; B65H 9/002; B65H 43/08; B65H 29/14; B65H 29/125

See application file for complete search history.

(56) References Cited

U.S. PATENT DOCUMENTS

| | | | | |
|---|---|---|---|---|
| 8,056,897 | B2 * | 11/2011 | deJong | B65H 9/002 271/227 |
| 8,523,166 | B2 * | 9/2013 | Jung | B65H 31/34 270/58.08 |
| 9,834,399 | B1 * | 12/2017 | Hashimoto | B26D 1/015 |

(Continued)

FOREIGN PATENT DOCUMENTS

| | | |
|---|---|---|
| JP | 2015-004771 | 1/2015 |
| JP | 2016-183039 | 10/2016 |
| JP | 2017208628 A * | 11/2017 |

*Primary Examiner* — Patrick Cicchino

(74) *Attorney, Agent, or Firm* — Squire Patton Boggs (US) LLP

(57) ABSTRACT

A sheet stacking apparatus includes: a sheet stacking part on which a sheet is stacked; a tilt detection sensor arranged on an upstream side in a conveying direction of the sheet of the sheet stacking part, and which detects a tail end in the conveying direction in the conveyed sheet; a pair of correction rollers arranged on a downstream side in the conveying direction of the tilt detection sensor and arranged immediately before an upstream side in the conveying direction of the sheet stacking part, and which corrects a tilt of the sheet; and a sheet holder that holds the sheet with the tilt corrected by the pair of correction rollers, and conveys and stacks the sheet on the sheet stacking part.

17 Claims, 11 Drawing Sheets

(56) References Cited

U.S. PATENT DOCUMENTS

| | | | | |
|---|---|---|---|---|
| 2018/0111773 | A1* | 4/2018 | Yokobori | B65H 9/002 |
| 2018/0162678 | A1* | 6/2018 | Nakano | B65H 35/0093 |
| 2018/0362274 | A1* | 12/2018 | Watanabe | B65H 9/002 |

* cited by examiner

SHEET STACKING APPARATUS AND IMAGE FORMING SYSTEM

The entire disclosure of Japanese patent Application No. 2017-216211, filed on Nov. 9, 2017, is incorporated herein by reference in its entirety.

BACKGROUND

Technological Field

The present invention relates to a sheet stacking apparatus and an image forming system for stacking sheets.

Description of the Related Art

Conventionally, image forming systems including an image forming apparatus for forming an image on a sheet and a sheet stacking apparatus on which sheets having images formed by the image forming apparatus are stacked.

The sheet stacking apparatus is required to align tilts of the sheets and stacks the sheet in order to enhance the processing accuracy by a post-processing apparatuses for performing post-processing such as stapling, punching, and binding, and to easily carry out the sheets by a user.

As technologies for correcting the tilt of the sheet, for example, there are ones described in JP 2015-4771 A and JP 2016-183039 A. JP 2015-4771 A and JP 2016-183039 A describe technologies for correcting the tilt of the sheet in the middle of conveyance of the sheet.

However, according to the technology described in JP 2015-4771 A, after the tilt correction of the sheet is performed, the sheet is discharged from a conveyance path in a state where the sheet is not held by another member. Further, in the technology described in JP 2016-183039 A, the tilt correction of the sheet is performed in the middle of a conveyance path. Therefore, in the technologies described in JP 2015-4771 A and JP 2016-183039 A, there is a risk that the sheet is tilted again when the sheet is conveyed to a sheet stacking part after the tilt correction.

SUMMARY

The present invention has been made in view of the above-described conventional problems and an objective of the present invention is to provide a sheet stacking apparatus and an image forming system capable of preventing sheets from tilting again after correction.

To achieve the abovementioned object, according to an aspect of the present invention, a sheet stacking apparatus reflecting one aspect of the present invention comprises: a sheet stacking part on which a sheet is stacked; a tilt detection sensor arranged on an upstream side in a conveying direction of the sheet of the sheet stacking part, and which detects a tail end in the conveying direction in the conveyed sheet; a pair of correction rollers arranged on a downstream side in the conveying direction of the tilt detection sensor and arranged immediately before an upstream side in the conveying direction of the sheet stacking part, and which corrects a tilt of the sheet; and a sheet holder that holds the sheet with the tilt corrected by the pair of correction rollers, and conveys and stacks the sheet on the sheet stacking part.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
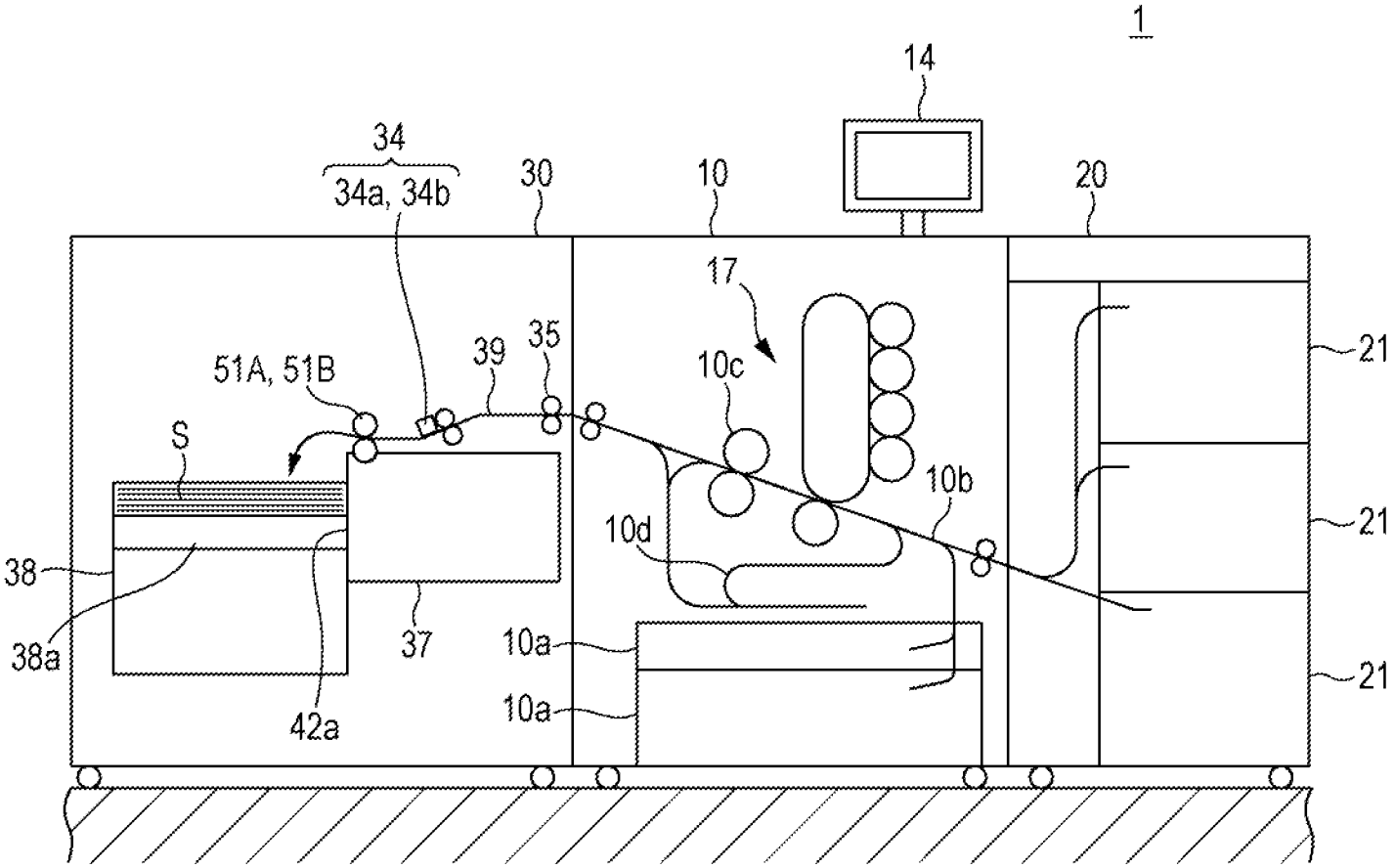
FIG. 1 is a schematic configuration diagram of an image forming system according to an embodiment of the present invention.

Hereinafter, a mode for implementing a sheet stacking apparatus and an image forming system of the present invention will be described with reference to FIGS. 1 to 11. Note that common members in the drawings are denoted by the same reference numerals. Further, the present invention is not limited to the following embodiment.

1. Embodiment

1-1. Configuration of Image Forming System

First, an overall configuration of an image forming system according to an embodiment (hereinafter referred to as "the present example") of the present invention will be described. FIG. 1 is a schematic configuration diagram of an image forming system 1 of the present example.

As illustrated in FIG. 1, the image forming system 1 includes an image forming apparatus 10, a sheet feeding apparatus 20, and a sheet stacking apparatus 30. In the image forming system 1, the sheet feeding apparatus 20, the image forming apparatus 10, and the sheet stacking apparatus 30 are arranged in order from an upstream side of a conveyance path of sheets and are connected in series. In the image forming system 1, the sheets can be conveyed among the apparatuses, and the apparatuses can perform communication with one another. Note that the image forming system 1 of the present example is not limited to the configuration illustrated in FIG. 1, and a sheet processing apparatus that processes the sheet such as stapling, punching, and binding may be arranged between the image forming apparatus 10 and the sheet stacking apparatus 30 or on a downstream side of the sheet stacking apparatus 30.

The sheet feeding apparatus 20 includes a plurality (three in the present example) of sheet feed trays 21, and can store a large amount of sheets. Then, the sheet feeding apparatus 20 feeds the sheet stored in the sheet feed tray 21 to the image forming apparatus 10.

The image forming apparatus 10 forms an image on the fed sheet. The image forming apparatus 10 includes a plurality of sheet feed trays 10*a*, a conveyance path 10*b*, an image former 17, a fixer 10*c*, a reverse conveyance path 10*d*, and an operation display part 14. The operation display part 14 is installed on a top of the image forming apparatus 10. The operation display part 14 is configured such that a display panel and a touch panel (operation part) are overlapped with each other, and enables operation by an operator and display of information.

The plurality of sheet feed trays 10*a* is installed in a lower part in the image forming apparatus 10. The sheet fed from the plurality of sheet feed trays 10*a* or the sheet feeding apparatus 20 is conveyed onto the conveyance path 10*b*. The image former 17 is provided in the middle of the conveyance path 10*b*.

The image former 17 includes, for example, image forming units of a plurality of colors (cyan, magenta, yellow, black, and the like), and can form a color toner image on the sheet. The fixer 10*c* to which the sheet on which the toner image has been formed is conveyed is arranged on a downstream side in a sheet conveying direction (simply referred to as "downstream side") of the image former 17.

The fixer 10*c* applies a pressure to and heals the conveyed sheet to fix the toner image transferred on a front side of the sheet onto the sheet. The sheet for which the fixing processing has been performed by the fixer 10*c* is conveyed to the sheet stacking apparatus 30 or to the reverse conveyance path 10*d* by the conveyance path 10*b*.

The reverse conveyance path 10*d* branching on a downstream side of the fixer 10*c* and joining the conveyance path 10*b* on an upstream side of the image former 17 is connected to the conveyance path 10*b*. The reverse conveyance path 10*d* is provided with a reverser for reversing the sheet. When the front and back or the front and rear are inverted/reversed by the reverser, the sheet passes through the reverse conveyance path 10*d* and is conveyed to the conveyance path 10*b* on an upstream side of the image former 17 or to the conveyance path 10*b* on a downstream side of the fixer 10*c*. Then, the sheet discharged from the conveyance path 10*b* of the image forming apparatus 10 is conveyed to the sheet stacking apparatus 30.

1-2. Configuration Example of Sheet Stacking Apparatus 30

Next, a configuration of the sheet stacking apparatus 30 will be described with reference to FIGS. 2 to 4.

Figure 2:
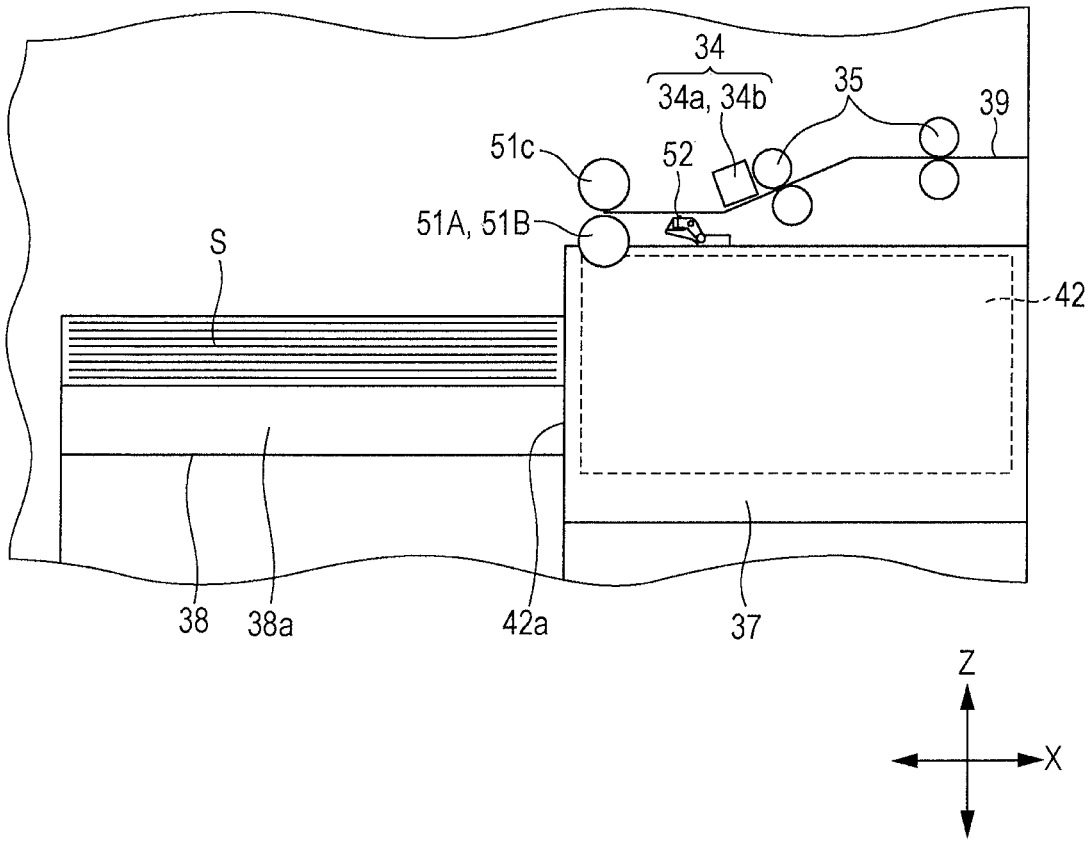
FIG. 2 is a schematic configuration diagram illustrating a sheet stacking apparatus according to the embodiment of the present invention.

FIG. 2 is a schematic configuration diagram illustrating the sheet stacking apparatus 30.

Hereinafter, a direction in which the sheet is conveyed from the image forming apparatus 10 is defined as a conveying direction X, and a direction orthogonal to the conveying direction X and orthogonal to an up-down direction is defined as a width direction Y. Then, a direction orthogonal to both the conveying direction X and the width direction Y is defined as an up-down direction Z.

As illustrated in FIGS. 1 and 2, the sheet stacking apparatus 30 includes a sheet detector 34, a plurality of conveyance rollers 35, a sheet stacker 37, a sheet stacking part 38, and a conveyance path 39. The conveyance path 39 conveys the sheet conveyed from the image forming apparatus 10 to the sheet stacker 37 and the sheet stacking part 38. Further, the plurality of conveyance rollers 35 and the sheet detector 34 are arranged on the conveyance path 39.

Figure 6:
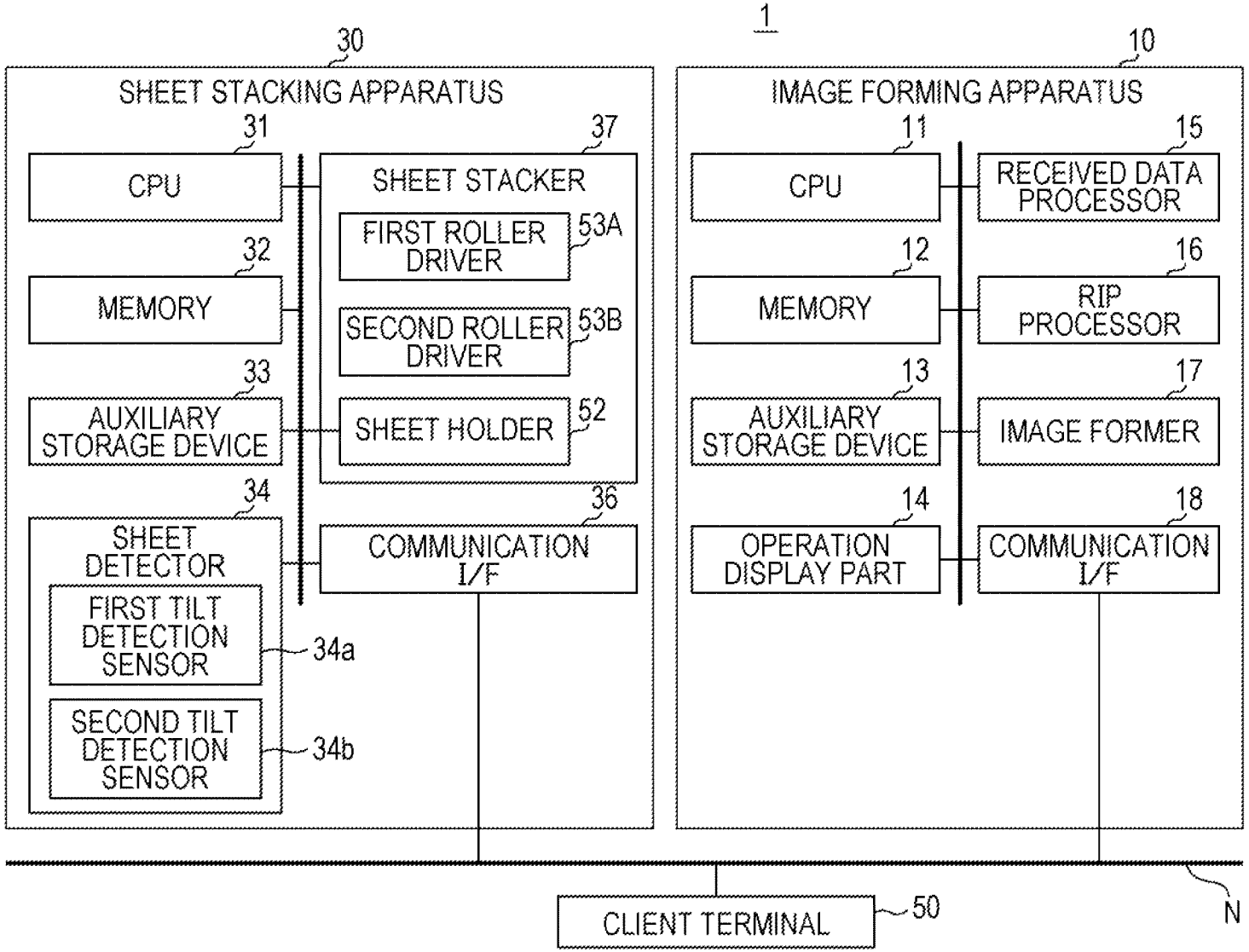
FIG. 6 is a block diagram illustrating a configuration of a control system of the image forming system according to the embodiment of the present invention.

The sheet detector 34 includes a first tilt detection sensor 34*a* and a second tilt detection sensor 34*b* (see FIG. 6). The first tilt detection sensor 34*a* and the second tilt detection sensor 34*b* are arranged on an upstream side in the conveying direction X of the correction rollers 51A and 51B of the sheet stacker 37 to be described below. Further, the first lilt detection sensor 34*a* and the second tilt detection sensor 34*b* are arranged with a space in a width direction Y (see FIGS. 7A to 7D). Then, the first tilt detection sensor 34*a* and the second tilt detection sensor 34*b* detect a tail end Sa in the conveying direction X in a conveyed sheet S.

Further, the sheet detector 34 is arranged between the conveyance roller 35 arranged the most downstream in the conveying direction X of the plurality of conveyance rollers 35, and the pair of correction rollers 51A and 51B provided on the sheet stacker 37 to be described below.

[Sheet Stacking Part]

The sheet stacking part 38 includes a stacking tray 38*a* and an elevator (not illustrated) that moves up and down the stacking tray 38*a* in the up-down direction Z. The sheets S conveyed by the sheet stacker 37 are stacked on the stacking tray 38*a*. The sheet stacker 37 is arranged on an upstream side in the conveying direction X of the sheet stacking part 38.

[Sheet Stacker]

Figure 3:
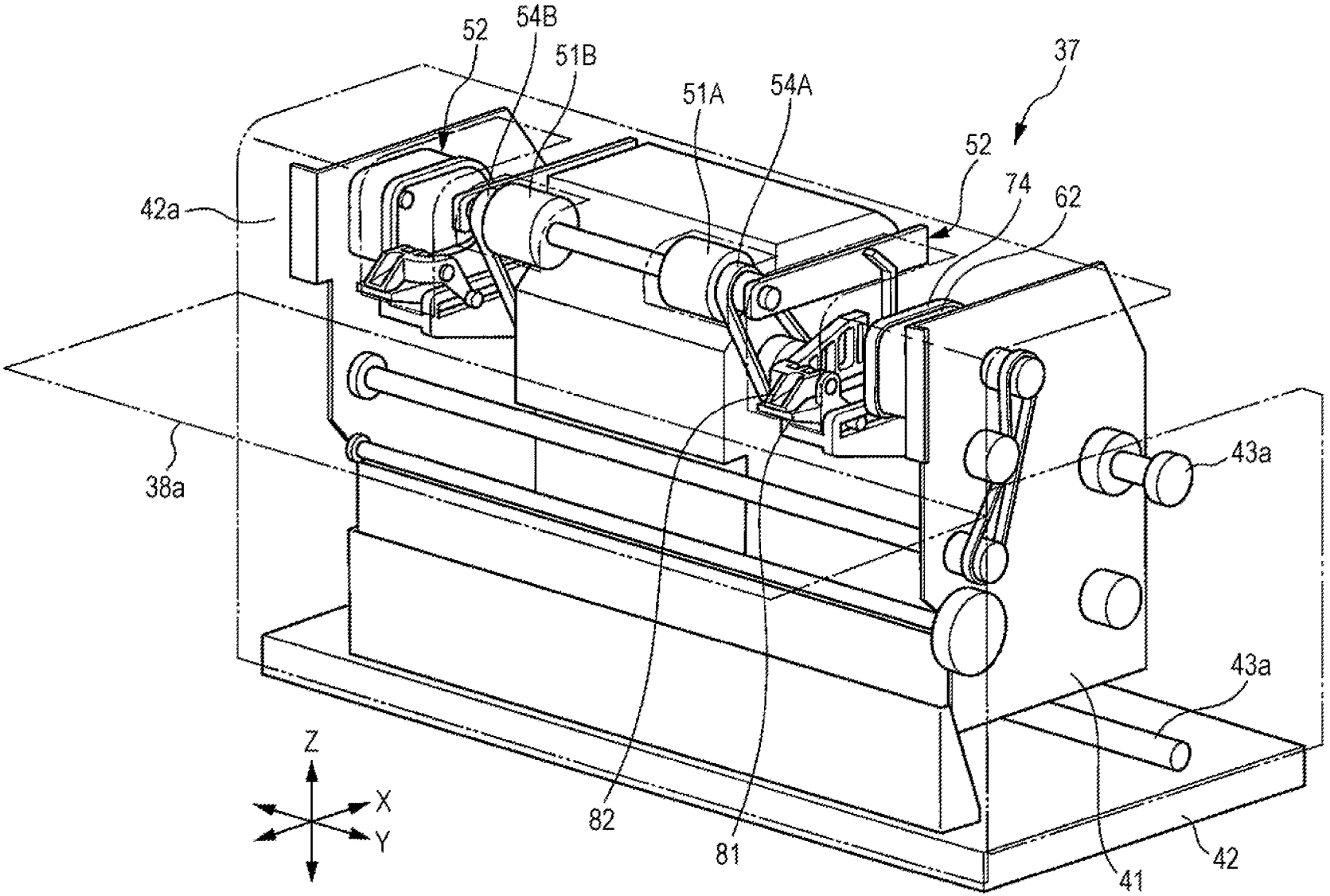
FIG. 3 is a perspective view illustrating a sheet stacker of the sheet stacking apparatus according to the embodiment of the present invention.
Figure 4:
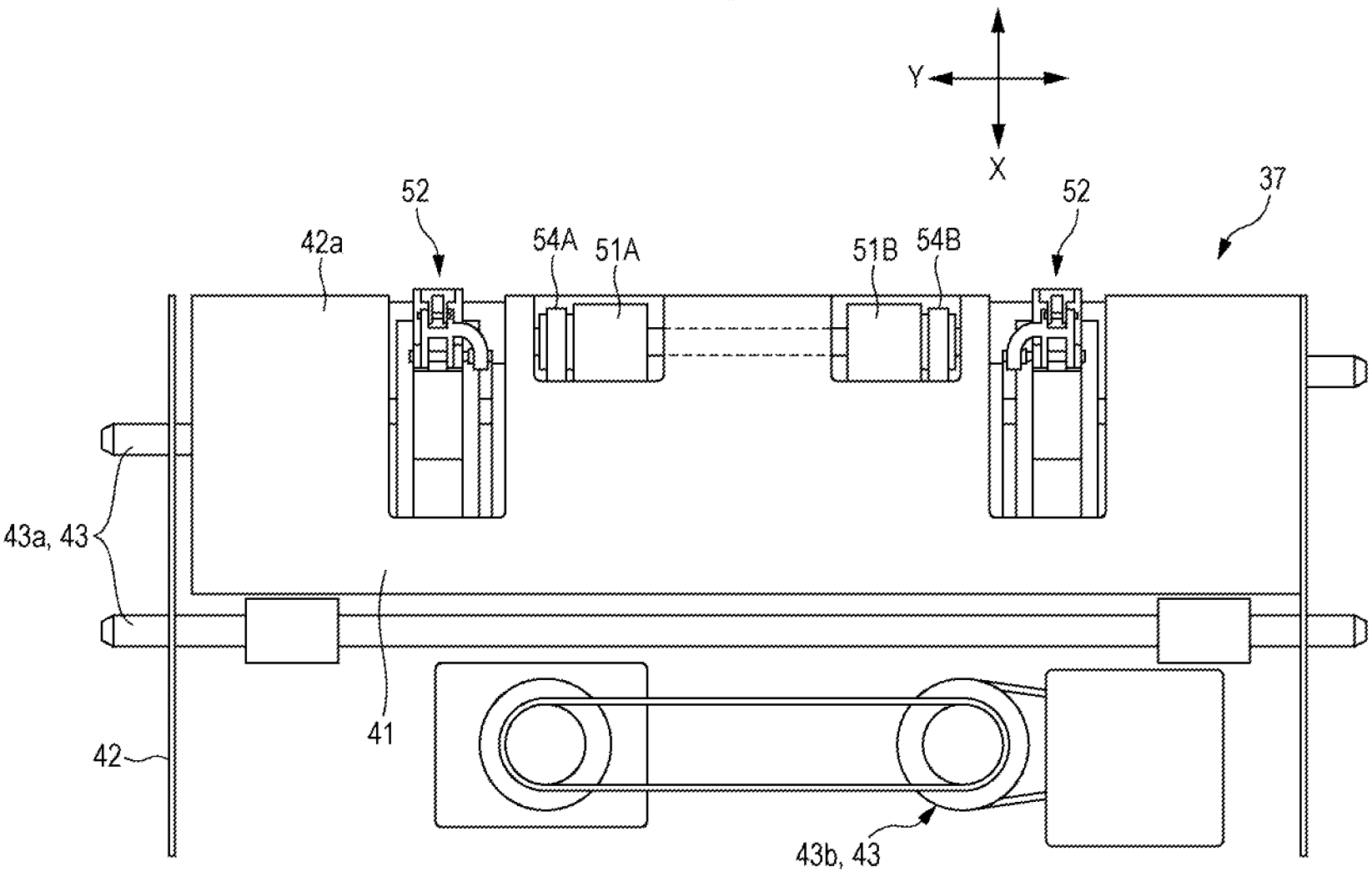
FIG. 4 is a plan view illustrating the sheet stacker of the sheet stacking apparatus according to the embodiment of the present invention.

FIG. 3 is a perspective view illustrating the sheet stacker 37 and FIG. 4 is a plan view illustrating the sheet stacker 37.

As illustrated in FIGS. 3 and 4, the sheet stacker 37 includes a stacking conveyance unit 41, a housing 42, and a width direction mover 43. The housing 42 is formed in a hollow and substantially rectangular parallelepiped shape. In the housing 42, the stacking conveyance unit 41 is housed via the width direction mover 43. The housing 42 includes a contact surface 42*a* with which a downstream-side end in the conveying direction X, that is, the tail end, of the sheet S stacked on the sheet stacking part 38, comes into contact. The contact surface 42*a* faces the sheet slacking part 38. Further, an opening is formed in the contact surface 42*a*, the opening facing the correction rollers 51A and 51B provided in the slacking conveyance unit 41 to be described below and sheet holders 52 and 52.

The width direction mover 43 movably supports the stacking conveyance unit 41 in the width direction Y with respect to the housing 42. The width direction mover 43 includes a guide shaft 43*a* and a movement driver 43*b*. Both ends in the width direction Y of the guide shaft 43*a* are fixed to the housing 42. Then, the guide shaft 43*a* penetrates the stacking conveyance unit 41 in the width direction Y and movably supports the stacking conveyance unit 41 in the width direction Y. Then, when the movement driver 43*b* is driven, the stacking conveyance unit 41 moves in the width direction Y along the guide shaft 43*a*.

[Stacking Conveyance Unit]

Figure 5:
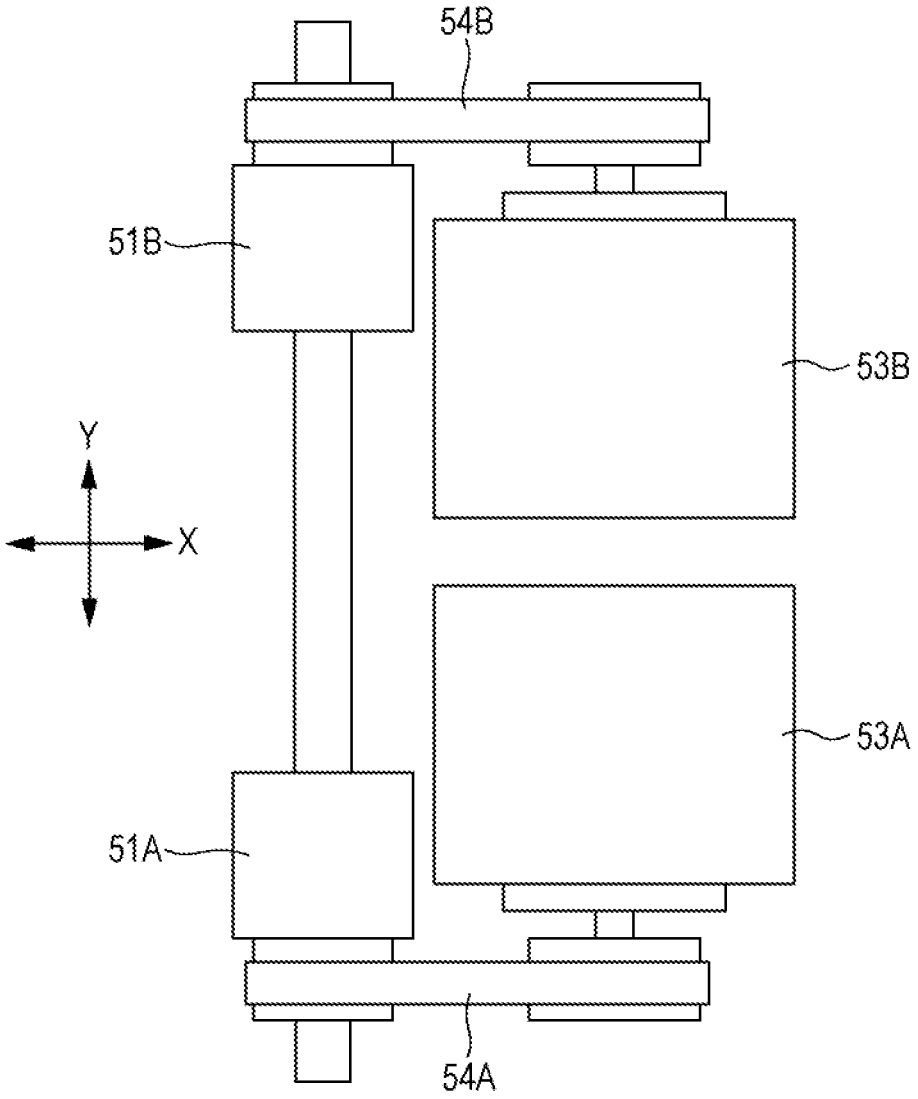
FIG. 5 is a plan view illustrating correction rollers of the sheet stacking apparatus according to the embodiment of the present invention.

The stacking conveyance unit 41 includes the pair of correction rollers 51A and 51B, the two sheet holders 52 and 52, and two roller drivers 53A and 53B (see FIG. 5). The pair of correction rollers 51A and 51B are arranged at an upper end in the up-down direction Z and a corner in a downstream-side end in the conveying direction X in the stacking conveyance unit 41. Then, the pair of correction rollers 51A and 51B is arranged immediately before an upstream side in the conveying direction X in the sheet stacking part 38. Further, no other rollers are arranged on a downstream side in the conveying direction X of the pair of correction rollers 51A and 51B, and the pair of correction rollers 51A and 51B is the conveyance rollers arranged the most downstream on the conveyance path 39.

As described above, the first tilt detection sensor 34*a* and the second tilt detection sensor 34*b* constituting the sheet detector 34 are arranged on the upstream side in the conveying direction X of the pair of correction rollers 51A and 51B (see FIG. 2). As described above, the sheet detector 34 is arranged between the conveyance roller 35 arranged the most downstream in the conveying direction X of the plurality of conveyance rollers 35, and the pair of correction rollers 51A and 51B. In other words, no other conveyance rollers 35 are arranged between the pair of correction rollers 51A and 51B, and the first tilt detection sensor 34*a* and the second tilt detection sensor 34*b*. Further, the pair of correction rollers 51A and 51B has driven rollers 51*c* respectively facing the correction rollers 51A and 51B in the up-down direction Z.

FIG. 5 is a plan view illustrating the correction rollers 51A and 51B.

The first correction roller 51A and the second correction roller 51B are arranged with a space in the width direction Y. The first correction roller 51A is connected to a drive shaft of a first miler driver 53A via a first drive belt 54A. The first correction roller 51A is rotationally driven by the first roller driver 53A. Further, the second correction roller 51B is connected to a drive shaft of a second roller driver 53B via a second drive belt 54B. The second correction roller 51B is rotationally driven by the second roller driver 53B.

Further, the first roller driver 53A and the second roller driver 53B are connected to a CPU 31 that is an example of a controller to be described below, and are individually controlled. Therefore, rotation speeds, so-called conveyance speeds of the sheet S of the first correction roller 51A and the second correction roller 51B are configured to be individually controllable. Then, the CPU 31 corrects the conveyance speeds of the first correction roller 51A and the second correction roller 51B to correct the tilt of the conveyed sheet S.

[Sheet Holder]

As illustrated in FIGS. 3 and 4, the two sheet holders 52 and 52 are arranged outside the pair of correction milers 51A and 51B in the width direction Y. Note that the two sheet holders 52 and 52 have the same configuration. The sheet holder 52 includes a gripper member 61 and a gripper mover 62.

The gripper member 61 includes a lower gripper 81 and an upper gripper 82. The upper gripper 82 is rotatably supported by the lower gripper 81 via a rotation shaft 85. A downstream-side end in the conveying direction X in the upper gripper 82 approaches or separates from the lower gripper 81. Then, the end of the upper gripper 82 approaches the lower gripper 81 to hold the conveyed sheet S. The lower gripper 81 is movably supported by the gripper mover 62.

The gripper mover 62 includes a gripper driver and a drive roller (not illustrated), a plurality of rollers, and a drive belt 74 formed in an endless manner. The drive belt 74 is wound around the drive roller and the plurality of rollers. Then, when the gripper driver is driven, the drive belt 74 rotates along the drive roller and the plurality of rollers.

Further, the gripper member 61 connected to the drive belt 74 moves in the conveying direction X and the up-down direction Z together with the rotation operation of the drive belt 74. As the gripper member 61 moves in the up-down direction Z, the gripper member 61 can move from below in the up-down direction Z of the conveyance path 39 on which the sheet S passes through to the conveyance path 39.

Further, the sheet holders 52 and 52 that hold the sheet S and the correction milers 51A and 51B that correct the tilt of the sheet S are provided in one member of the stacking conveyance unit 41. Further, as described above, the stacking conveyance unit 41 is movably supported in the width direction Y by the width direction mover 43. With the configuration, the sheet holders 52 and 52 and the correction rollers 51A and 51B can be moved in the width direction Y at the same time.

Note that, in the present example, the example in which the two sheet holders 52 and 52 are arranged outside the correction rollers 51A and 51B in the width direction Y has been described. However, an example is not limited thereto. The two sheet holders 52 and 52 may be arranged between the first correction roller 51A and the second correction roller 51B in the width direction Y.

1-3. Configuration Example of Control System

Next, a configuration example of a control system of the image forming system 1 will be described with reference to FIG. 6.

FIG. 6 is a block diagram illustrating a configuration of a control system of the apparatuses included in the image forming system 1.

As illustrated in FIG. 6, in the image forming system 1, the apparatuses are connected to a client terminal 50 via a network N. For example, a personal computer is applied to the client terminal 50. The client terminal 50 generates image data for image formation by document creation or image formation application on the basis of a user's input operation. Further, the client terminal 50 has a function to generate an image formation job including image formation setting information (also called "job ticket") and image data, and output the image formation job to the image forming apparatus 10.

The image forming apparatus 10 receives the image formation job output from the client terminal 50 via the network N, and forms and outputs an image on the sheet on the basis of the image formation setting and the image formation data in the image formation job (hereinafter, referred to as "image formation processing"). The image forming apparatus 10 may be a multi-function peripheral (MFP) having a plurality of functions (an image forming function, a copying function, a scanning function, and the like).

The image forming apparatus 10 includes a CPU 11 constituting a controller, a memory 12, an auxiliary storage device 13, the operation display part 14, a received data processor 15, a RIP processor 16, the image former 17, and a communication I/F 18. The devices are communicatively connected to one another via a system bus.

The central processing unit (CPU) 11 is a central processor that controls the operation of the devices of the image forming apparatus 10 and arithmetic processing. The CPU 11 reads a program code of software for realizing functions according to the present embodiment from the auxiliary storage device 13 and executes the program code. Note that the image forming apparatus 10 may include a processing device such as an MPU in place of the CPU 11.

The memory 12 is a main storage device, and variables, parameters, and the like that have occurred in the middle of arithmetic processing are temporarily written in the memory 12. A random access memory (RAM) is applied to the memory 12, for example.

The auxiliary storage device 13 is a storage device that plays an auxiliary role of the memory 12. The auxiliary storage device 13 usually has a mechanism capable of storing data for a long time. In the auxiliary storage device 13, a program for causing the image forming apparatus 10 to function is recorded in addition to an OS and various parameters.

The operation display part 14 is configured such that a touch panel as an operation part is stacked on a flat panel display as a display part. The operation display part 14 generates an operation signal corresponding to the content of the operation input from the user, and supplies the generated operation signal to the CPU 11. Further, the operation display part 14 displays a processing result of the CPU 11.

The received data processor 15 analyzes the image formation job input to the image forming apparatus 10 and processes the received image formation data. Each image formation data processed by the received data processor 15 is supplied to the RIP processor 16.

The RIP processor 16 reflects the image formation setting to the image formation data, converts (RIP processes) the image formation data into a language (page description language: PDL) identifiable in the image forming apparatus 10, and outputs the converted data. Examples of the language identifiable in the image forming apparatus 10 include PCL and PostScript.

The image former 17 forms an image on the sheet on the basis of the RIP-processed image formation data output from the RIP processor 16. The image former 17 is configured as a printer engine.

As the communication I/F 18, a network interface card (NIC) is used, for example, and has a configuration capable of transmitting/receiving various data to/from the devices via the network N.

A controller including the received data processor 15 and the RIP processor 16 may be connected to the network N. Then, the image formation data processed by the received data processor 15 and the RIP processor is input to the image forming apparatus 10 and the sheet stacking apparatus 30.

The sheet stacking apparatus 30 receives the image formation data from the image forming apparatus 10, and determines the size and basis weight of the sheet to be conveyed, and the presence or absence of post-processing such as stapling, punching, and binding.

The sheet stacking apparatus 30 includes a CPU 31, a memory 32, an auxiliary storage device 33, the sheet detector 34, a communication I/P 36, the sheet stacker 37, and the like. The devices are communicatively connected to one another via a system bus.

The CPU 31, which is an example of a controller, is a central processor that controls the operation of the devices of the sheet stacking apparatus 30 and arithmetic processing. The CPU 31 reads a program code of software for realizing functions according to the present embodiment from the auxiliary storage device 33 and executes the program code. Note that the sheet stacking apparatus 30 may include a processing device such as an MPU in place of the CPU 31.

The memory 32 is a main storage device, and variables, parameters, and the like that have occurred in the middle of arithmetic processing are temporarily written in the memory 32. A random access memory (RAM) is applied to the memory 32, for example.

The auxiliary storage device 33 is a storage device that plays an auxiliary role of the memory 32. The auxiliary storage device 33 usually has a mechanism capable of storing data for a long time. In the auxiliary storage device 33, a program for causing the sheet stacking apparatus 30 to function is recorded in addition to an OS and various parameters.

The sheet detector 34 includes the first tilt detection sensor 34*a* and the second tilt detection sensor 34*b*. Then, the first tilt detection sensor 34*a* and the second tilt detection sensor 34*b* detect a tail end Sa (see FIGS. 7A to 7D) of the sheet S conveyed on the conveyance path 39. Then, the first tilt detection sensor 34*a* and the second tilt detection sensor 34*b* output detected detection information to the CPU 31.

The sheet stacker 37 includes the first roller driver 53A that rotationally drives the first correction miler 51A, the second roller driver 53B that rotationally drives the second correction roller 51B, and the sheet holder 52. The first miler driver 53A rotationally drives the first correction roller 51A on the basis of the drive signal from the CPU 31, and the second roller driver 53B rotationally drives the second correction roller 51B on the basis of the drive signal from the CPU 31. Further, when receiving the detection information from the first tilt detection sensor 34*a* or the second tilt detection sensor 34*b*, the CPU 31 rotates the correction rollers 51A and 51B arranged on the same side in the width direction Y as the detected tilt detection sensor 34*a* or 34*b* by a predetermined amount T1 (see FIGS. 7A to 7D) and stops the correction rollers 51A and 51B. With the operation, the tilt of the sheet S is corrected when both the pair of correction rollers 51A and 51B stop.

The sheet holder 52 drives the gripper driver of the gripper mover 62 on the basis of the drive signal from the CPU. With the operation, the gripper member 61 of the sheet holder 52 performs a holding operation of the sheet S, a stacking operation of the sheet, and the like.

As the communication I/F 36, a network interface card (NIC) is used, for example, and has a configuration capable of transmitting/receiving various data to/from the devices via the network N.

2. Tilt Correction Operation of Sheet

Next, the tilt correction operation of the sheet S by the sheet stacking apparatus 30 having the above-described configuration will be described with reference to FIGS. 7A to 7D.

FIGS. 7A to 7D are explanatory diagrams illustrating the tilt correction operation.

First, the CPU 31 controls the first roller driver 53A and the second roller driver 53B so that the first correction roller 51A and the second correction roller 51B have the same conveyance speed, and conveys the sheet S toward the downstream side in the conveying direction X. Then, the first tilt detection sensor 34*a* and the second tilt detection sensor 34*b* detect the tail end Sa of the sheet S. In the example illustrated in FIGS. 7A and 7B, the first tilt detection sensor 34*a* first detects the tail end Sa of the sheet S, and then the second tilt detection sensor 34*b* detects the tail end Sa of the sheet S. Therefore, it can be seen that the first tilt detection sensor 34*a* side in the width direction Y of the sheet S is tilted to the downstream side in the conveying direction X.

Figure 7A:
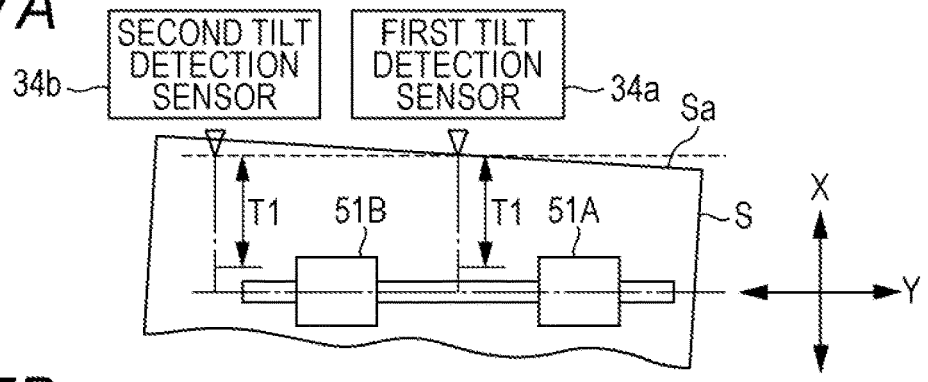
FIGS. 7A to 7D are explanatory diagrams illustrating a tilt correction operation in the sheet stacking apparatus according to the embodiment of the present invention.
Figure 7B:
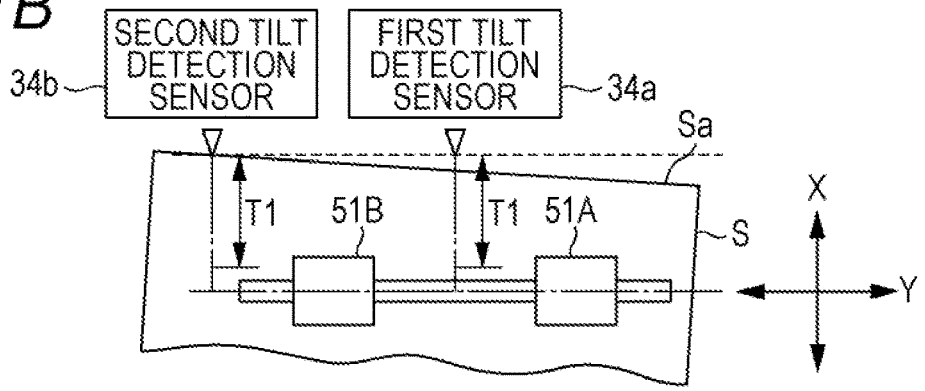
Figure 7C:
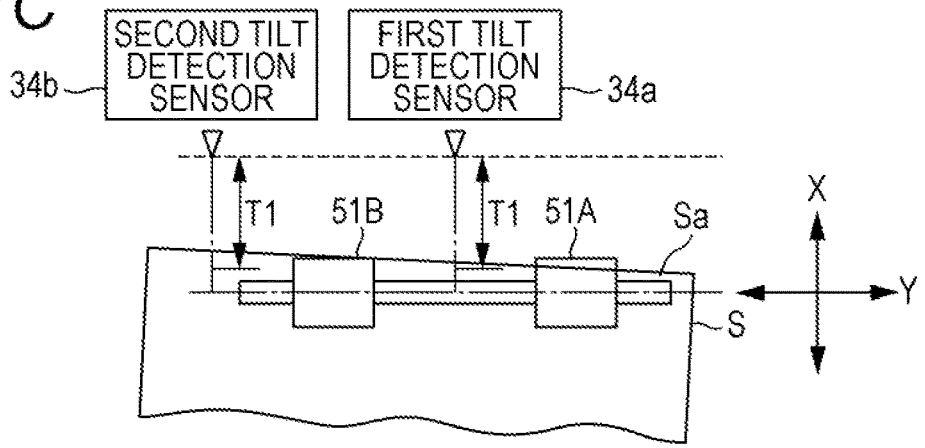

As illustrated in FIG. 7C, when the sheet S is conveyed by the predetermined amount T1 by the first correction roller 51A and the second correction roller 51B after the first tilt detection sensor 34*a* detects the tail end Sa of the sheet S, the CPU 31 controls the first roller driver 53A to stop the rotation of the first correction roller 51A. With the operation, conveyance of the sheet S on the first correction roller 51A side in the width direction Y is stopped.

Figure 7D:
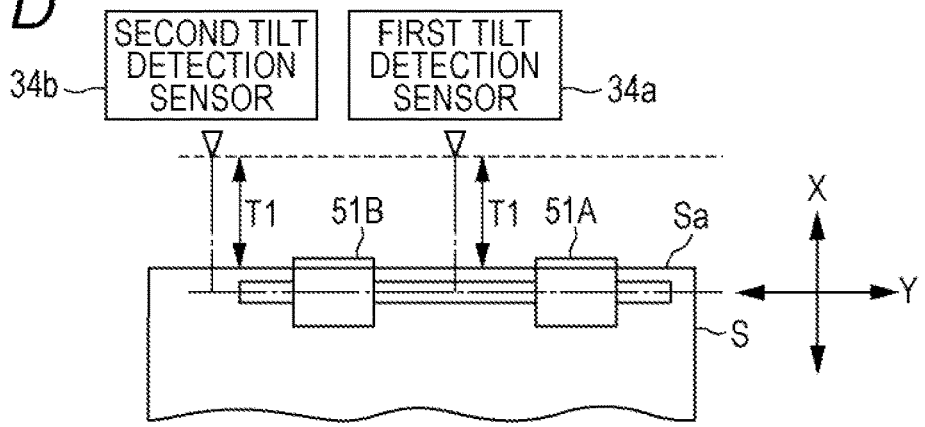

Next, as illustrated in FIG. 7D, after the sheet S is conveyed by the predetermined amount T1 after the second tilt detection sensor 34*b* detects the tail end Sa of the sheet S, the CPU 31 controls the second roller driver 53B to stop the rotation of the second correction roller 51B. As a result, as illustrated in FIG. 7D, the tilt of the sheet S is corrected.

As described above, no other conveyance milers are arranged on the downstream side in the conveying direction X of the pair of correction rollers 51A and 51B, and the stacking tray 38*a* of the sheet stacking part 38 is arranged. Then, no other conveyance rollers are arranged between the first correction roller 51A and the second correction roller 51B, and the first tilt detection sensor 34*a* and the second tilt detection sensor 34*b*. In addition, the tail end Sa, not a leading end, in the conveying direction X of the sheet S is detected and the tilt of the sheet is corrected. When the pair of correction rollers 51A and 51B corrects the tilt of the sheet S, the other conveyance rollers are not in contact with the sheet S. Therefore, when the tilt correction of the sheet S is performed, separation of other conveyance rollers from the sheet S is not necessary, and the structure can be simplified.

3. Stacking Operation of Sheet Stacker

Next, an example of a stacking operation of the sheet S by the sheet stacker 37 having the above-described configuration will be described with reference to FIGS. 8 to 11.

Figure 8:
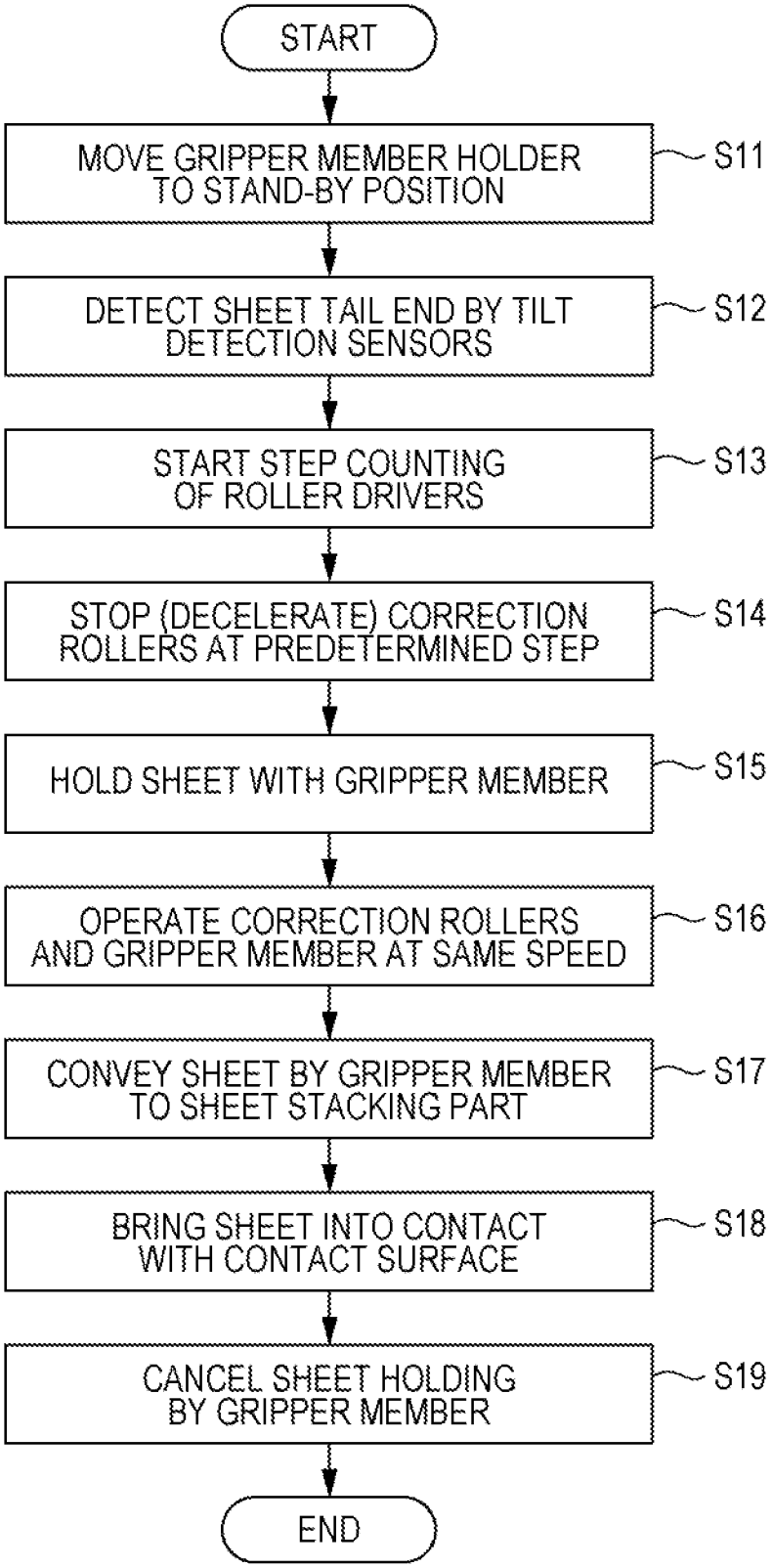
FIG. 8 is a flowchart illustrating a stacking operation on a sheet stacking part in the sheet stacking apparatus according to the embodiment of the present invention.

FIG. 8 is a flowchart illustrating the stacking operation on the sheet stacking part 38, and FIGS. 9A and 9B to FIG. 11 are explanatory diagrams illustrating the stacking operation on the sheet stacking part 38.

Figure 9A:
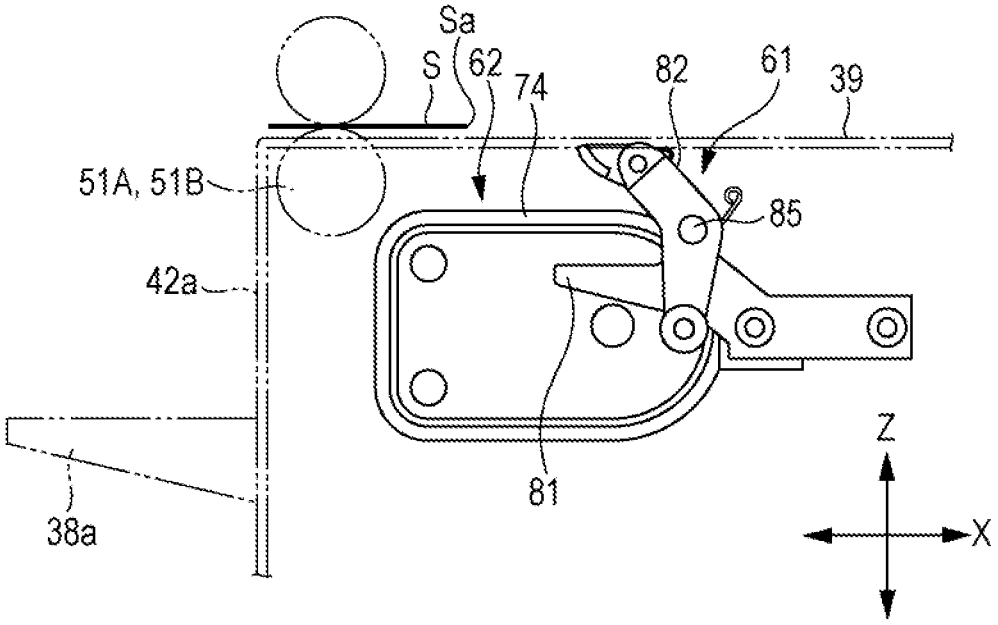
FIGS. 9A and 9B are explanatory diagrams illustrating a stacking operation on the sheet stacking part in the sheet stacking apparatus according to the embodiment of the present invention.

First, as illustrated in FIG. 8, the CPU 31 controls the gripper mover 62 of the sheet holder 52 to move the gripper member 61 to a standby position (step S11). That is, as illustrated in FIG. 9A, the gripper member 61 is moved to a position where the upper gripper 82 of the gripper member 61 does not protrude into the conveyance path 39. With the operation, the sheet S conveyed on the conveyance path 39 can be prevented from coming in contact with the gripper member 61.

Next, the tilt detection sensors 34*a* and 34*b* detect the tail end Sa of the sheet S (step S12). Then, the CPU 31 starts step counting of the roller drivers 53A and 53B that rotationally drive the correction rollers 51A and 51B arranged on the same side in the width direction Y as the tilt detection sensors 34*a* and 34*b* that have detected the tail end Sa in the processing in step S12 (step S13).

Next, the correction rollers 51A and 51B are stopped or decelerated at a predetermined step (step S14). That is, after the sheet S is conveyed by the correction rollers 51A and 51B by the predetermined amount T1 as illustrated in FIGS. 7A to 7D, the rotation of the correction rollers 51A and 51B are stopped or decelerated. Then, as illustrated in FIG. 7D, the tilt of the sheet S is corrected as the rotation of both the correction rollers 51A and 51B is stopped or decelerated.

Figure 9B:
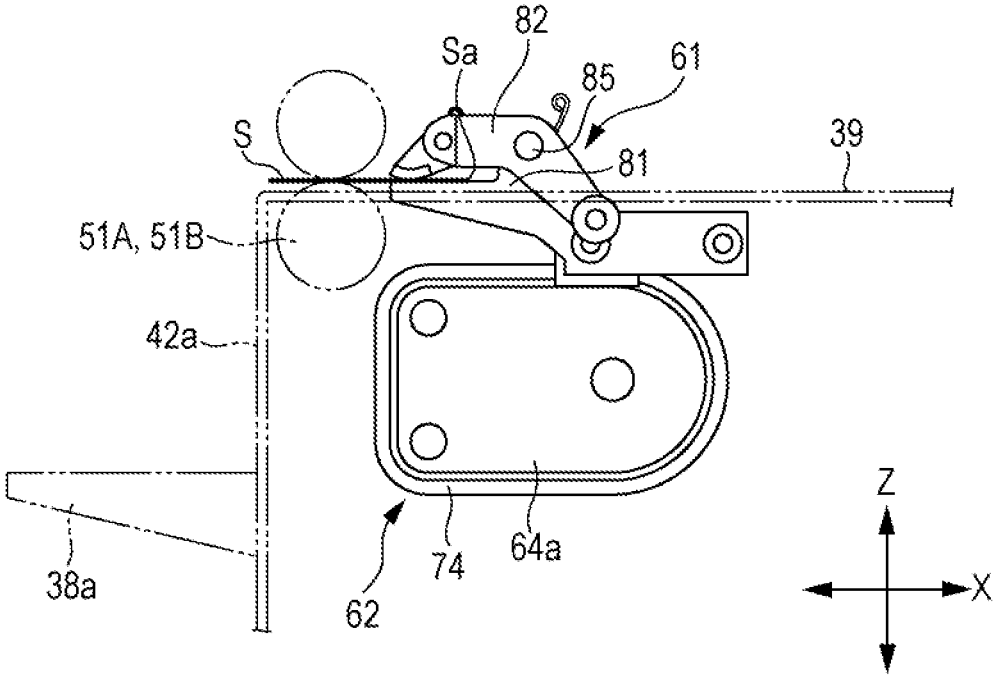

Next, the CPU 31 controls the gripper mover 62 of the sheet holder 52 to move the gripper member 61 upward in the up-down direction Z, and moves the gripper member 61 from an upstream side to a downstream side in the conveying direction X in the state where the upper gripper 82 is separated from the lower gripper 81. Then, as illustrated in FIG. 9B, the upper gripper 82 is rotated to hold the end of the sheet S together with the lower gripper 81 (step S15). That is, the gripper member 61 holds the sheet S before the sheet S passes through the pair of correction rollers 51A and 51B.

Further, as illustrated in FIGS. 3 and 4, two gripper members 61 are provided with a space in the width direction Y. Therefore, since the end of the sheet S is held by the two gripper members 61, the sheet S can be prevented from tilting again after tilt correction.

Next, the CPU 31 controls the roller drivers 53A and 53B and the gripper mover 62 to make the conveyance speed of the sheet S in the pair of correction rollers 51A and 51B and the moving speed in the conveying direction X in the gripper member 61 be the same speed (step S16). Since the conveyance speed of the sheet S in the pair of correction rollers 51A and 51B and the moving speed in the conveying direction X in the gripper member 61 are the same, the sheet S can be prevented from tilting again.

Figure 10A:
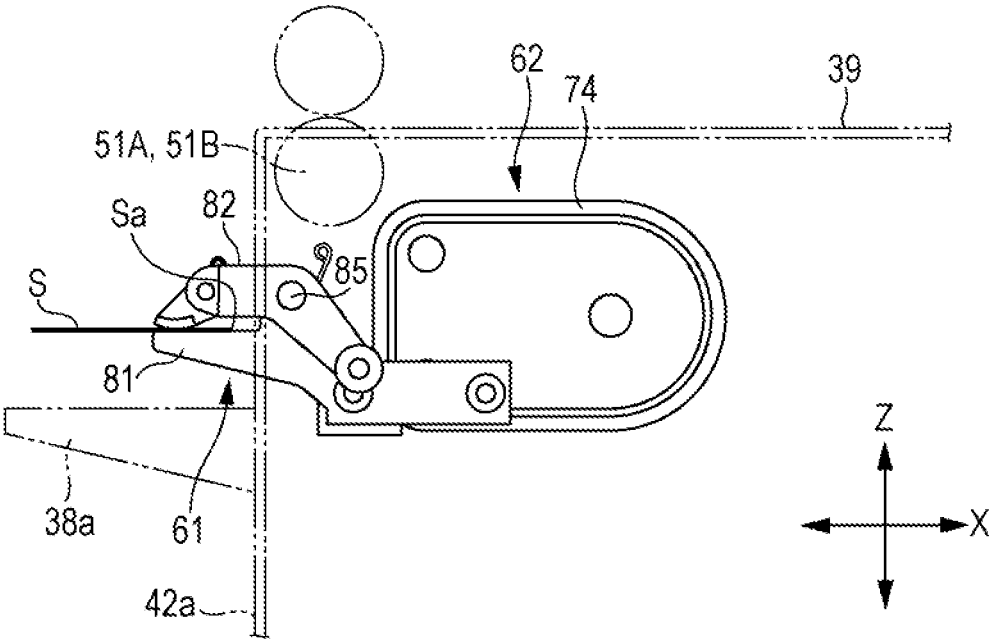
FIGS. 10A and 10B are explanatory diagrams illustrating a stacking operation on the sheet stacking part in the sheet stacking apparatus according to the embodiment of the present invention.

Then, after the sheet S passes through the pair of correction rollers 51A and 51B, the CPU 31 controls the gripper mover 62 to move the gripper member 61 downward in the up-down direction Z, and conveys the sheet S to the sheet stacking part 38, as illustrated in FIG. 10A (step S17).

Figure 10B:
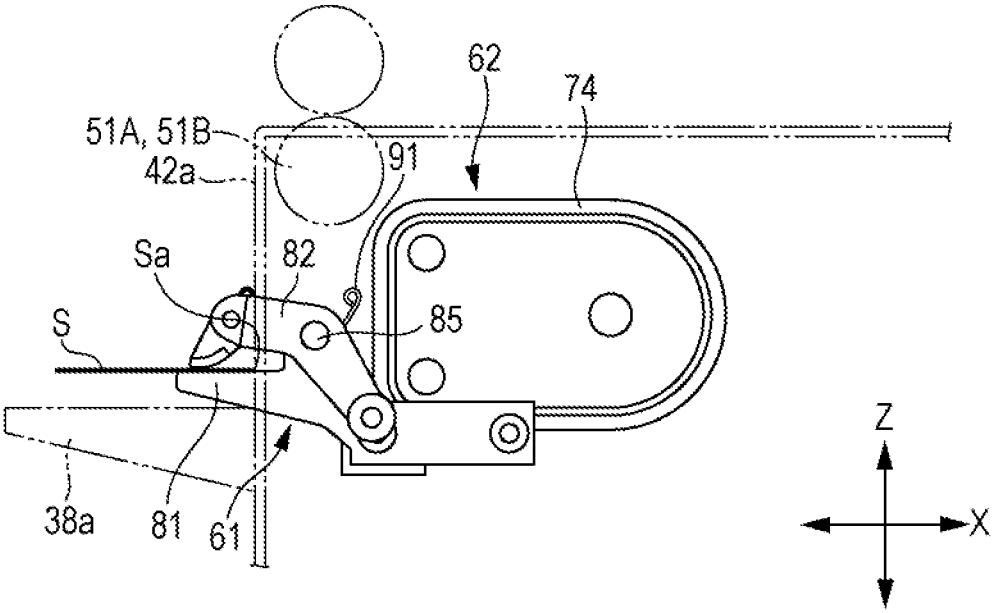

Next, as illustrated in FIG. 10B, the gripper member 61 is moved toward the upstream side in the conveying direction X, and the tail end Sa of the sheet S is brought into contact with the contact surface 42*a* (step S18). As a result, a minute tilt of the sheet S, which cannot be corrected by the correction rollers 51A and 51B, can be corrected. As a result, the sheets S can be stacked on the stacking tray 38*a* of the sheet stacking part 38 in a state where the ends of the sheets S are aligned, and the alignment properties of the sheets S can be improved.

Figure 11:
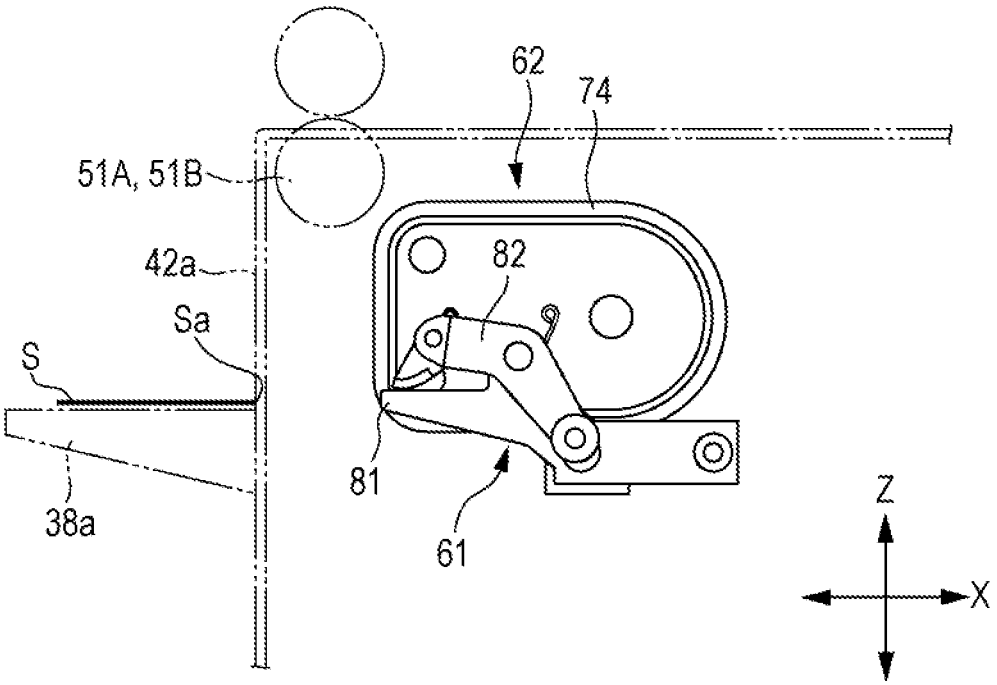
FIG. 11 is an explanatory diagram illustrating a stacking operation on the sheet stacking part in the sheet stacking apparatus according to the embodiment of the present invention.

Next, as illustrated in FIG. 11, the gripper member 61 is pulled out from the sheet S, and the holding of the sheet S by the gripper member 61 is released (step S19). As a result, the stacking operation of the sheet S on the sheet stacking pan 38 by the sheet stacker 37 is completed.

According to the sheet stacking apparatus 30 of the present example, the tilt correction of the sheet is performed by the pair of correction rollers 51A and 51B arranged immediately before the upstream side in the conveying direction X of the sheet stacking part 38, whereby the tilt correction of the sheet S can be performed in the state where the other conveyance rollers are not in contact with the sheet. As a result, it is not necessary to provide a mechanism for separating the other conveyance rollers at the time of the correction operation, and thus the structure can be simplified.

Further, the corrected sheet S is held and conveyed by the sheet holder 52, whereby the sheet can be prevented from tilting again. Further, when the sheet S is staked on the sheet stacking part 38, the end of the sheet S is brought into contact with the contact surface 42*a*, whereby the minute tilt of the sheet S can be corrected.

As described above, the embodiment of the sheet stacking apparatus and the image forming system, including the functions and effects, has been described. However, the sheet stacking apparatus and the image forming system of the present invention are not limited to the above-described embodiment, and various modifications can be made within the scope not deviating from the gist of the invention described in the claims.

In the above-described embodiment, the configuration to form the color image using the four sets of image forming units has been described. However, as the image forming apparatus according to the present invention, a configuration to form a single color image using one image former may be adopted. Further, the image forming apparatus is not limited to a copier, and may be a printer, a facsimile, or a multi-function peripheral provided with a plurality of functions.

Further, in the above-described embodiment, the example in which the control of the sheet stacker 37 is performed by the CPU 31 of the sheet stacking apparatus 30 has been described. However, an embodiment is not limited to the example, and for example, the control of the sheet stacker 37 may be performed by the CPU 11 of the image forming apparatus 10.

Note that, in the present specification, the words such as "parallel" and "orthogonal" have been used but the words do not have only the strict "parallel" and "orthogonal" meanings. The words include "parallel" and "orthogonal" and may further include a state of "substantially parallel" or "substantially orthogonal" where the functions can be exerted.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet stacking apparatus comprising:

a sheet stacking part on which a sheet is stacked;

a tilt detection sensor arranged on an upstream side in a conveying direction of the sheet of the sheet stacking part, and which detects a tail end in the conveying direction in the conveyed sheet;

a pair of correction rollers arranged on a downstream side in the conveying direction of the tilt detection sensor and arranged immediately before an upstream side in the conveying direction of the sheet stacking part, and which corrects a tilt of the sheet; and a sheet holder that holds the sheet with the tilt corrected by the pair of correction rollers, and conveys and stacks the sheet on the sheet stacking part.

2. The sheet stacking apparatus according to claim 1, wherein the tilt detection sensor is arranged between a conveyance roller arranged most downstream in the conveying direction of a plurality of conveyance rollers for conveying the sheet, and the pair of correction rollers.

3. The sheet stacking apparatus according to claim 1, wherein the sheet holder holds the sheet before the sheet passes through the pair of correction rollers.

4. The sheet stacking apparatus according to claim 3, wherein the sheet holder includes a gripper member that holds an end of the sheet; and a gripper mover that movably supports the gripper member, wherein a moving speed in the conveying direction of the gripper member after holding the sheet is same as a conveyance speed of the sheet after correction in the pair of correction rollers.

5. The sheet stacking apparatus according to claim 1, further comprising:

a contact surface with which the tail end of the sheet stacked on the sheet stacking part comes into contact, wherein the sheet holder brings the tail end of the sheet into contact with the contact surface and stacks the sheet on the sheet stacking part.

6. The sheet stacking apparatus according to claim 1, wherein the pair of correction rollers is conveyance rollers arranged most downstream on a conveyance path on which the sheet is conveyed.

7. An image forming system comprising:

an image forming apparatus that forms an image on a sheet; and a sheet stacking apparatus to which the sheet is conveyed from the image forming apparatus, wherein the sheet stacking apparatus according to claim 1 is applied to the sheet stacking apparatus.

8. The sheet stacking apparatus according to claim 1, additionally comprising conveyance rollers for conveying the sheet, wherein when the pair of correction rollers corrects the tilt of the sheet, the conveyance rollers do not make contact with the sheet.

9. The sheet stacking apparatus according of claim 1, additionally comprising conveyance rollers positioned immediately upstream of the pair of correction rollers, such that the pair of correction rollers corrects the tilt of the sheet after the sheet has completely passed through the conveyance rollers.

10. The sheet stacking apparatus according to claim 1, additionally comprising conveyance rollers, wherein no conveyance roller is arranged between the pair of correction rollers and the tilt detection sensor.

11. The sheet stacking apparatus according to claim 1, wherein the sheet holder comprises a plurality of sheet holders.

12. The sheet stacking apparatus according to claim 1, wherein the sheet holder comprises a pair of sheet holders, wherein the pair of correction rollers is positioned in between the pair of sheet holders.

13. The sheet stacking apparatus according to claim 1, wherein the sheet holder comprises:

(a) a first gripper member; and (b) a second gripper member, spaced apart in a width direction from the first gripper member, wherein the first gripper member and the second gripper member are configured to hold an end of the sheet so as to prevent the sheet from tilting after the pair of correction rollers corrects the tilt of the sheet.

14. The sheet stacking apparatus according to claim 1, additionally comprising a width direction mover configured to move the sheet holder and the pair of correction rollers in a width direction.

15. The sheet stacking apparatus according to claim 1, wherein each of the correction rollers is configured to be individually controllable.

16. The sheet stacking apparatus according to claim 1, additionally comprising:

(a) a first roller diver that rotationally drives one of the correction rollers; and (b) a second roller driver that rotationally drives the other correction roller of the pair of correction rollers, wherein a CPU independently controls a conveyance speed of the one correction roller by the first roller driver and a conveyance speed of the other correction roller by the second roller driver.

17. The sheet stacking apparatus according to claim 1, wherein the sheet holder comprises an upper gripper and a lower gripper, wherein in operation, the sheet holder comprises:

(a) a standby mode where the upper gripper does not protrude into a conveyance path of the sheet;

(b) a holding mode where the upper and lower grippers are moved in an upward and downstream direction to an end of the sheet, and engage with one another, for holding the end of the sheet after the pair of correction rollers has corrected the tilt of the sheet;

(c) a conveyance mode where the conveyance speed of the sheet in the pair of correction rollers and the moving speed of the upper and lower grippers in the conveyance direction of the sheet is the same so as to prevent any tilt of the sheet; and (d) a stacking mode after the sheet passes through the pair of correction rollers, the stacking mode comprises moving the upper and lower grippers to the sheet stacking part and then moving the upper and lower grippers in a upstream direction so that the tail end of the sheet contacts a contact surface of the sheet stacking apparatus, whereby the sheet is stacked.

* * * * *